US006538581B2

(12) United States Patent
Cowie

(10) Patent No.: US 6,538,581 B2
(45) **Date of Patent: *Mar. 25, 2003**

(54) APPARATUS FOR INDICATING AIR TRAFFIC AND TERRAIN COLLISION THREAT TO AN AIRCRAFT

(75) Inventor: Mark Cowie, Plymouth (GB)

(73) Assignee: BAE Systems PLC, Hants (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/383,403

(22) Filed: Aug. 26, 1999

(65) Prior Publication Data

US 2001/0013836 A1 Aug. 16, 2001

Related U.S. Application Data

(63) Continuation of application No. PCT/GB98/00611, filed on Feb. 26, 1998.

(30) Foreign Application Priority Data

Feb. 26, 1997 (GB) ..... 9703954

(51) Int. Cl.[7] ..... G08G 5/04

(52) U.S. Cl. ..... 340/961; 340/970; 342/65; 701/14; 701/301

(58) Field of Search ..... 340/961, 970, 340/963; 342/29, 65; 701/4, 9, 14, 301

(56) References Cited

U.S. PATENT DOCUMENTS

| | | | | | |
|---|---|---|---|---|---|
| 4,646,244 | A | | 2/1987 | Bateman et al. | 340/963 |
| 4,835,537 | A | * | 5/1989 | Manion | 340/961 |
| 5,111,400 | A | | 5/1992 | Yoder | 342/29 |
| 5,442,556 | A | * | 8/1995 | Boyes et al. | |
| 5,488,563 | A | | 1/1996 | Chazelle et al. | 340/970 |
| 5,493,309 | A | | 2/1996 | Bjornholt | |
| 5,798,712 | A | * | 8/1998 | Coquin | 340/961 |
| 5,945,926 | A | * | 8/1999 | Ammar et al. | 340/970 |
| 6,002,347 | A | * | 12/1999 | Daly et al. | 340/961 |
| 6,133,867 | A | * | 10/2000 | Eberwine et al. | 342/29 |

FOREIGN PATENT DOCUMENTS

| | | |
|---|---|---|
| EP | 0 717 330 | 6/1996 |
| EP | 0 750 238 | 12/1996 |
| GB | 1 334 680 | 10/1973 |
| WO | WO 85/03566 A1 | 8/1985 |

* cited by examiner

*Primary Examiner*—Brent A. Swarthout
(74) *Attorney, Agent, or Firm*—Kenyon & Kenyon

(57) ABSTRACT

Includes means for monitoring the position and behavior of air traffic in the vicinity of the aircraft and generating a warning or avoidance signal for air traffic predicted to be on a collision course. The apparatus also includes means for monitoring the position and behavior of the aircraft relative to terrain in the vicinity of the aircraft flight path to generate a warning or avoidance signal for terrain features predicted to provide a collision threat. Means are provided for receiving the traffic warning signals and terrain warning signals comparing the signals and generating a combined warning or advisory signal which indicates an action for the aircraft which avoids both air traffic and terrain collisions.

42 Claims, 5 Drawing Sheets

APPARATUS FOR INDICATING AIR TRAFFIC AND TERRAIN COLLISION THREAT TO AN AIRCRAFT

CROSS REFERENCE TO RELATED APPLICATIONS

This application is a continuation of PCT/GB98/00611, filed Feb. 26, 1998.

BACKGROUND OF THE INVENTION

1. Field of the Invention

This invention relates to apparatus for indicating air traffic and terrain collision threats to an aircraft.

2. Related Art

Air traffic advisory are known which are able to provide a warning of potential collision courses with neighboring aircraft. Such known systems monitor the speed and flight path of other aircraft with respect to the aircraft in question and provide advisory warnings when any aircraft is predicted to pass within a predetermined distance of the aircraft in question.

Terrain advisory systems are also known which interrogate a terrain database with respect to the aircraft flight path and provide advisory warnings when the aircraft flight path is predicted to take the aircraft into a hazardous situation. These known systems operate independently of each other and do not coordinate traffic and terrain advisory warnings. It is therefore possible for a terrain advisory system to produce a warning requiring a climb recover maneuver which is potentially dangerous due to the unknown presence of air traffic above the aircraft in question. It is also possible with a known stand-alone traffic advisory system for it to produce a warning requiring the aircraft to descend into a hazardous terrain situation.

There is thus a need for a generally improved apparatus for indicating air traffic and terrain collision threats to an aircraft which takes into account both terrain and air traffic conditions.

SUMMARY OF THE INVENTION

According to a first aspect of the present invention, there is provided apparatus for indicating air traffic and terrain collision threats to an aircraft, including traffic advisory means for monitoring the position and behavior of air traffic in the vicinity of an in-flight aircraft provided with the apparatus and for generating a warning and/or avoidance signal for air traffic predicted to be on a collision course with the in-flight aircraft, terrain advisory means for monitoring the position and behavior of the in-flight aircraft relative to terrain in the vicinity of the aircraft flight path and for generating a warning and/or avoidance signal for terrain features predicted to provide a collision threat on the aircraft flight path, and interactive means for receiving traffic warning and/or avoidance signals from the traffic advisory means and terrain warning and/or avoidance signals from the terrain advisory means, comparing said signals and generating a combined warning and/or advisory signal which indicates an action for the aircraft which avoids both air traffic and terrain collisions.

Preferably, the traffic advisory means includes a transponder for receiving signals relating to the absolute and/or relative positions of air traffic in the vicinity of the aircraft and a traffic warning and/or avoidance signal generator operable to receive output signals from the transponder, calculate and monitor the position and behavior of air traffic in the vicinity of the aircraft and generate said traffic warning and/or avoidance signal.

Conveniently the traffic warning and/or avoidance signal generator is connectable to a flight management system of the aircraft to receive aircraft operating information therefrom.

Advantageously, the terrain advisory means includes a store of representations of terrain and obstacles in and around the aircraft flight path, a search logic device for retrieving data from the store within a predetermined latitudinal and longitudinal envelope defined relative to the aircraft position and velocity and a terrain warning and/or avoidance signal generator operable to receive, from a navigation system of the aircraft, signals representative of the latitude, longitude and altitude of the aircraft, calculate the predicted aircraft ground flight path and generate the terrain warning and/or avoidance signal.

Preferably, the terrain warning and/or avoidance signal generator includes a comparator for comparing the predicted aircraft ground flight path with the worst case terrain profile so that the terrain warning and/or avoidance signal is issued if either the predicted aircraft altitude falls below a predetermined minimum clearance height at any point along the predicted ground flight path or if intersection with the terrain is predicted to be less than a predetermined time to impact.

Conveniently the interactive means interlinks and forms part of the traffic warning and/or avoidance signal generator and the terrain warning and/or avoidance signal generator.

Advantageously, the apparatus includes an auditory warning device and a visual avoidance display device receiving output signals from said traffic warning and/or avoidance signal generator and said terrain warning and/or avoidance signal generator, which warning device additionally feeds an output signal to said display device.

BRIEF DESCRIPTION OF THE DRAWINGS

For a better understanding of the present invention, and to show how the same may be carried into effect, reference will now be made, by way of example, to the accompanying drawings in which.

DETAILED DESCRIPTION

Apparatus according to the present invention for indicating air traffic and terrain collision threats to an aircraft utilises a terrain and obstacle database for a predetermined geographical area of interest to provide advisory warnings of the hazardous proximity of terrain or other air traffic and advises on the appropriate recovery action. The apparatus monitors the position, velocity and attitude of the aircraft in which it is installable and the position and velocity of air traffic in the vicinity of the aircraft to provide advisory indications of the position of terrain or other air traffic with respect to the aircraft.

Figure 1:
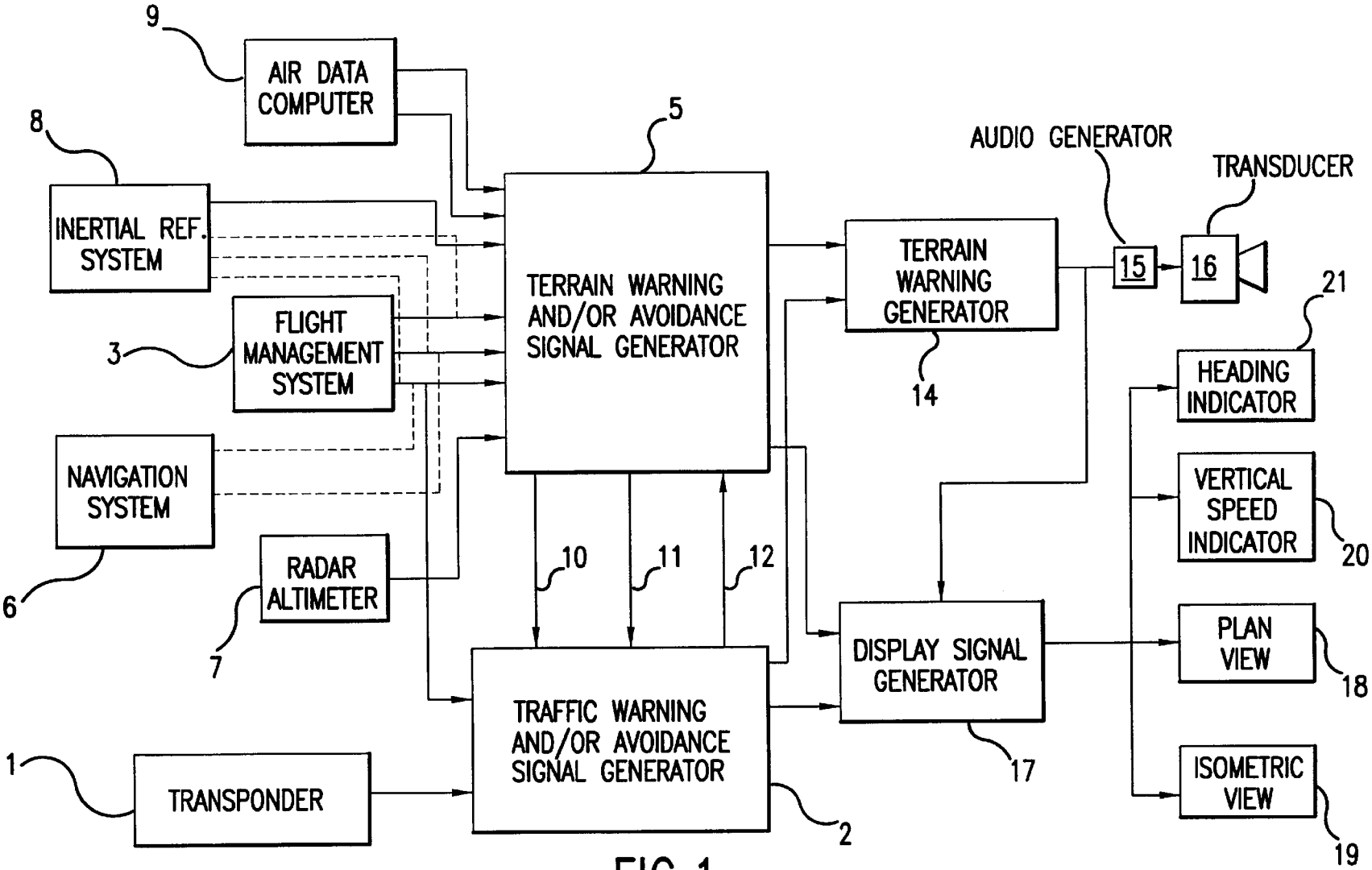
FIG. 1 is a schematic drawing of apparatus according to a first embodiment of the present invention for indicating air traffic and terrain collision threats to an aircraft.

To this end, the apparatus includes traffic advisory means generally shown in FIG. 1 for monitoring the position and behavior of air traffic in the vicinity of an in-flight aircraft provided with the apparatus and for generating a warning and/or avoidance signal for air traffic predicted to be on a collision course with the in-flight aircraft. The apparatus also includes terrain advisory means generally shown in FIG. 1 and in more detail in FIG. 2 of the accompanying drawings for monitoring the position and behavior of the in-flight aircraft relative to the terrain in the vicinity of the aircraft flight path and for generating a warning and/or avoidance signal for terrain features predicted to provide a collision threat on the aircraft flight path. Additionally the apparatus of the invention includes interactive means for receiving traffic warning and/or avoidance signals from the traffic advisory means and terrain advisory means, comparing said signals and generating a combined warning and/or advisory signal which indicates an action for the aircraft which avoids both air traffic and terrain collisions.

The traffic advisory means includes a transponder 1 operable to receive signals relating to the absolute and/or relative positions of air traffic in the vicinity of the aircraft. These signals may be received from a ground station, a space station or directly from other air traffic. Also forming part of the traffic advisory means is a traffic warning and/or avoidance signal generator 2 which is operable to receive output signals from the transponder 1 calculate and monitor the position and behavior of air traffic in the vicinity of the aircraft and generate the required traffic warning and/or avoidance signal. The generator 2 calculates the range, range rate, altitude, bearing and descent rate of individual aircraft in adjacent air traffic within a surveillance area. Thus the generator 2 monitors the flight path of the air traffic and issues a warning or advisory signal if the traffic is predicted to be on a collision course with the aircraft fitted with the apparatus of the invention.

FIG. 1 shows apparatus according to a first embodiment of the present invention in a block schematic form in which various analogue and digital implementations may be utilised. The surveillance area which the transponder 1 operates is defined relative to the aircraft carrying the apparatus and the coverage of the surveillance area as a function of the aircraft ground speed. The generator 2 is connectable to a flight management system 3 of the aircraft carrying the apparatus to receive aircraft operating information therefrom.

Figure 2:
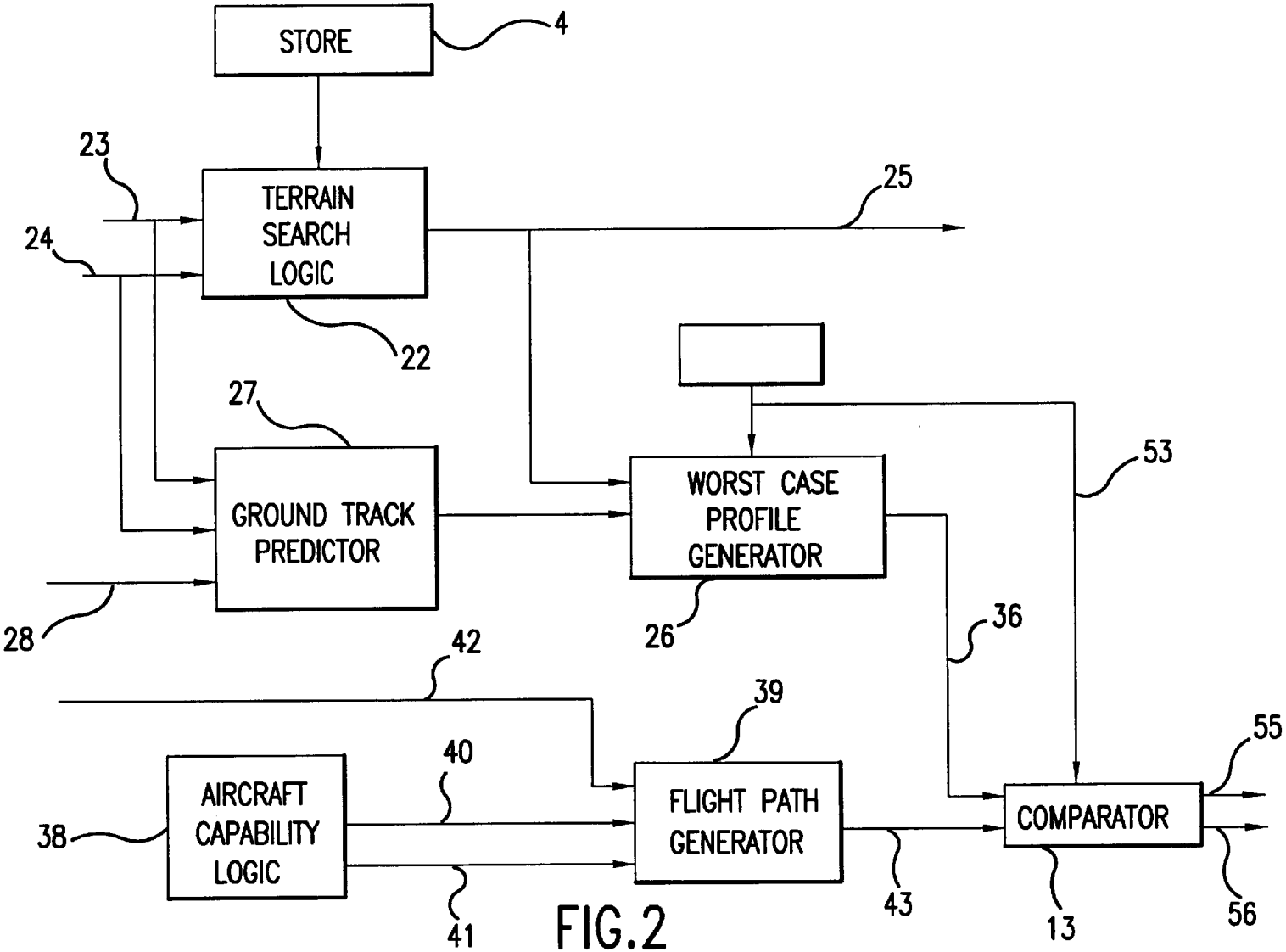
FIG. 2 is a block diagram illustrating in more detail a terrain warning and/or avoidance signal generator forming part of the apparatus of FIG. 1.

The terrain advisory means includes a store 4, as best seen in FIG. 2, for storing a representation of the terrain and obstacles around the aircraft in a memory. The store 4 holds an analog or digital representation of the terrain and obstacles within a predetermined geographical area of interest which area of interest should contain the complete aircraft flight path including possible diversion routes. A terrain search logic device is included which uses the estimated aircraft latitude and longitude signals as well as the aircraft ground speed and ground track signals to retrieve data from the store 4 representative of the terrain within a predetermined latitudinal and longitudinal envelope defined relative to the aircraft position and velocity.

Also forming part of the terrain advisory means is a terrain warning and/or avoidance signal generator 5 which is operable to receive, from a navigational system 6 of the aircraft, signals representative of the latitude, longitude and altitude of the aircraft, calculate the predicted aircraft ground flight path and generate the required terrain warning and/or avoidance signal. To this end the navigation system 6 may be a Terrain Reference Navigation (TRN) system which will provide an accurate location of the aircraft relative to the terrain database in the store 4. The terrain reference navigation system is connected to a radar altimeter 7 and is also operable to utilize, signals received from other navigation systems such as satellite navigation, or an Inertial Reference system 8 to produce an estimate of the aircraft position relative to the terrain database. In the absence of a terrain reference navigation system the aircraft navigation parameters may be obtained directly from existing navigation systems.

The traffic warning and/or avoidance signal generator 2 receives signals produced by the transponder 1 in addition to the maximum descent rate signal and terrain left/terrain right signals produced by the generator 5 of the terrain advisory means and calculates range, bearing, velocity vector and relative altitude for each aircraft within the surveillance area. The maximum descent rate is calculated by using recovery maneuvers for various aircraft descent rates and the proximity of hazardous terrain to the left or right of the aircraft is estimated by calculating worst case profiles for either side of the current carrier aircraft flight path. If the signals received from the transponder 1 provide the absolute air traffic position then the range and bearing can be obtained by comparing the target air traffic aircraft position with the absolute position of the aircraft carrying the apparatus of the invention. The generator 2 monitors the flight path of each aircraft in the air traffic surveillance area and predicts if any of the aircraft are likely to pass within a predetermined spacing of the aircraft carrying the apparatus of the invention. If an aircraft is predicted to pass within the minimum spacing then the generator 2 calculates the required avoidance action. This required avoidance action may be a horizontal or vertical, maneuver and will take account of the rate of closure of the threat aircraft, the maximum descent rate of the aircraft and the presence of hazardous terrain to the left or right of the aircraft.

The terrain warning and/or avoidance signal generator 5 is intended to receive signals from an air data computer 9 and a navigation system which preferably includes the inertial reference system 8, the flight management system 3 or the terrain reference navigation system 6 to determine the aircraft position and advise the pilot of the presence of potentially hazardous terrain.

The signal generators 2 and 5 are interconnected so that the maximum descent rate signal is passed from the generator 5 to the generator 2 via the line 10, the terrain left/right signal is passed from the generator 5 to the generator 2 by the line 11 and traffic signals are passed from the generator 2 to the generator 5 via line 12. Thus information about the proximity of other aircraft to the carrier aircraft is passed from the traffic warning generator 2 to the terrain warning generator 5. This information is used to ensure that if there are any aircraft above the carrier aircraft then any terrain pull up warning is issued earlier to allow a less severe recovery maneuver to be executed by both aircraft. Conventionally the generation of a pull up warning would require a severe vertical climb by the host aircraft which would take it towards any aircraft above, requiring these aircraft to execute similar vertical climbs to maintain the minimum vertical separation.

The terrain and/or avoidance signal generator 5 includes a comparator 13, see FIG. 2, for comparing the predicted aircraft ground flight path with the worst case terrain profile so that the terrain warning and/or avoidance signal is issued if either the predicted aircraft altitude falls below a predetermined minimum clearance height at any point along the predicted ground flight path or if intersection with the terrain is predicted to be less than a predetermined time to impact. Both the generators 2 and 5 are connected to a warning generator 14 so that it receives warnings and advisories generated by the generators 2 and 5. The generator 14 selects the most significant warning or advisory signal in the event of multiple warnings or advisory signals being generated concurrently and drives an audio generator 15 which generates a voice signal advising of the nature of the hazard and applies it to a transducer 16 which may be part of the cockpit communication system.

The apparatus also includes a display signal generator 17 which receives terrain information generated by the generator 5 and information on the presence of traffic within the surveillance area from the generator 2 and uses this information to control a visual display to display the presence of potentially threatening terrain or air traffic. The visual display may take the form of a plan view 18 of the terrain and traffic or an isometric view of the terrain and traffic 19. The colour of the terrain displayed and the colour and shape of traffic symbols may change to indicate the threat level. Thus the visual display shows the position of other aircraft relative to the aircraft carrying the apparatus of the invention. The colour of the terrain may change with the proximity of the terrain to the aircraft in the vertical plane and the display of terrain may also display signals received from the flight management system 3 such as aircraft flight path or position of airports. The display generator 17 also controls a vertical speed indicator 20 and a heading indicator 21 to indicate the appropriate evasive maneuver action. The terrain database store 4 is used by the ground collision avoidance function to determine if the aircraft flight plan is likely to lead the aircraft into a hazardous situation with respect to the ground. Additionally, terrain ahead of the aircraft can be displayed within the cockpit to increase the pilot situation awareness.

FIG. 2 shows the terrain warning and/or avoidance signal generator system in more detail in which the terrain database store 4 is connected to a terrain search logic 22 which also receives signals from the navigation system relating to the aircraft longitude, latitude and ground track. Thus position signals enter at 23, velocity signals enter at 24 and terrain signals are outputted from the logic 22 at 25. Using these signals the terrain search logic 22 calculates the area of potentially hazardous terrain and retrieves this data from the terrain database store 4. The area covered by the terrain search logic is configured to ensure that it encompasses, as a minimum, the predicted aircraft flight path ahead of the aircraft. The terrain retrieved by the search logic 22 is passed to the display generator 17 and the worst case terrain profile generator 26. The signal generator 5 operates by comparing the aircraft flight path against the terrain ahead of the aircraft. The worst case terrain profile generator 26 is employed to estimate the terrain ahead of the aircraft.

A ground track predictor 27 receives signals from the navigation system relating to the aircraft position, ground speed, ground track and turn rate signals and possibly acceleration as at 28 and estimates the most likely aircraft horizontal flight path. The predicted horizontal flight path allows for the current aircraft turn rate. The aircraft turn rate may be calculated from the rate of change of the ground track or by using the aircraft acceleration 28 both parallel and perpendicular to the current aircraft ground track. The generator 27 may produce more than one possible ground track to allow the presence of hazardous terrain to the left or right of the aircraft to be detected. Alternatively, if available, an externally generated horizontal flight path from an existing system on board the aircraft may be used such as from the flight management system 3. The worst case terrain profile generator 26 receives the predicted horizontal flight path from the ground track predictor 27 and produces a profile of the terrain over which the aircraft is likely to be flown. The minimum terrain clearance height may be a function of the aircraft configuration or a function of the proximity of the aircraft to an airfield.

Figure 3:
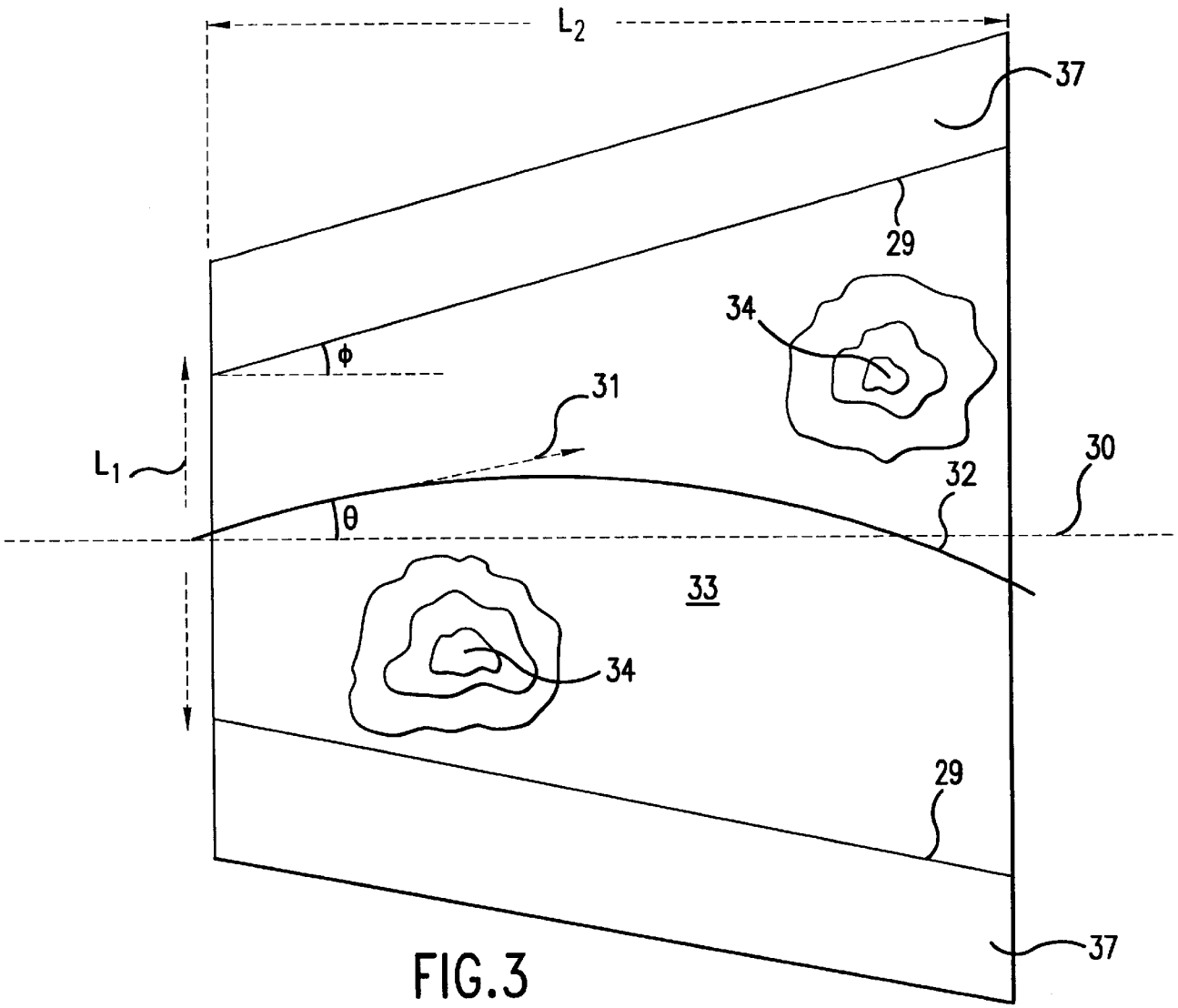
FIG. 3 is a diagrammatic view illustrating the terrain area scanned in apparatus according to FIG. 1.

As the predicted horizontal flight path is calculated using the current aircraft parameters consideration must be given to the possibility of errors in the navigation system and the predicted flight path. To allow for these errors the worst case terrain profile generator 26 creates the scan area ahead of the aircraft which encompasses the terrain over which the aircraft may be expected to fly. This scan area is shown in FIG. 3. The scan area consists of a tapered beam 29 whose centre line 30 is rotated from the current aircraft ground track 31 by the angle theta ($\theta$). The angle theta ($\theta$) is a function of the aircraft turn rate and allows the scan area to encompass the predicted horizontal flight path 32. The sides of the beam are opened out by the angle $\theta$. The angle $\theta$ is also a function of the aircraft turn rate and allows for a deviation from the predicted horizontal flight path 32. The width of the base of the beam $L_1$, is a function of the uncertainty in the aircraft position perpendicular to the aircraft ground track. If this information is not available directly from the navigation system, then it may be estimated using the knowledge of the navigation system used. The length of the beam $L_2$ is a function of the ground speed of the aircraft.

Figure 4:
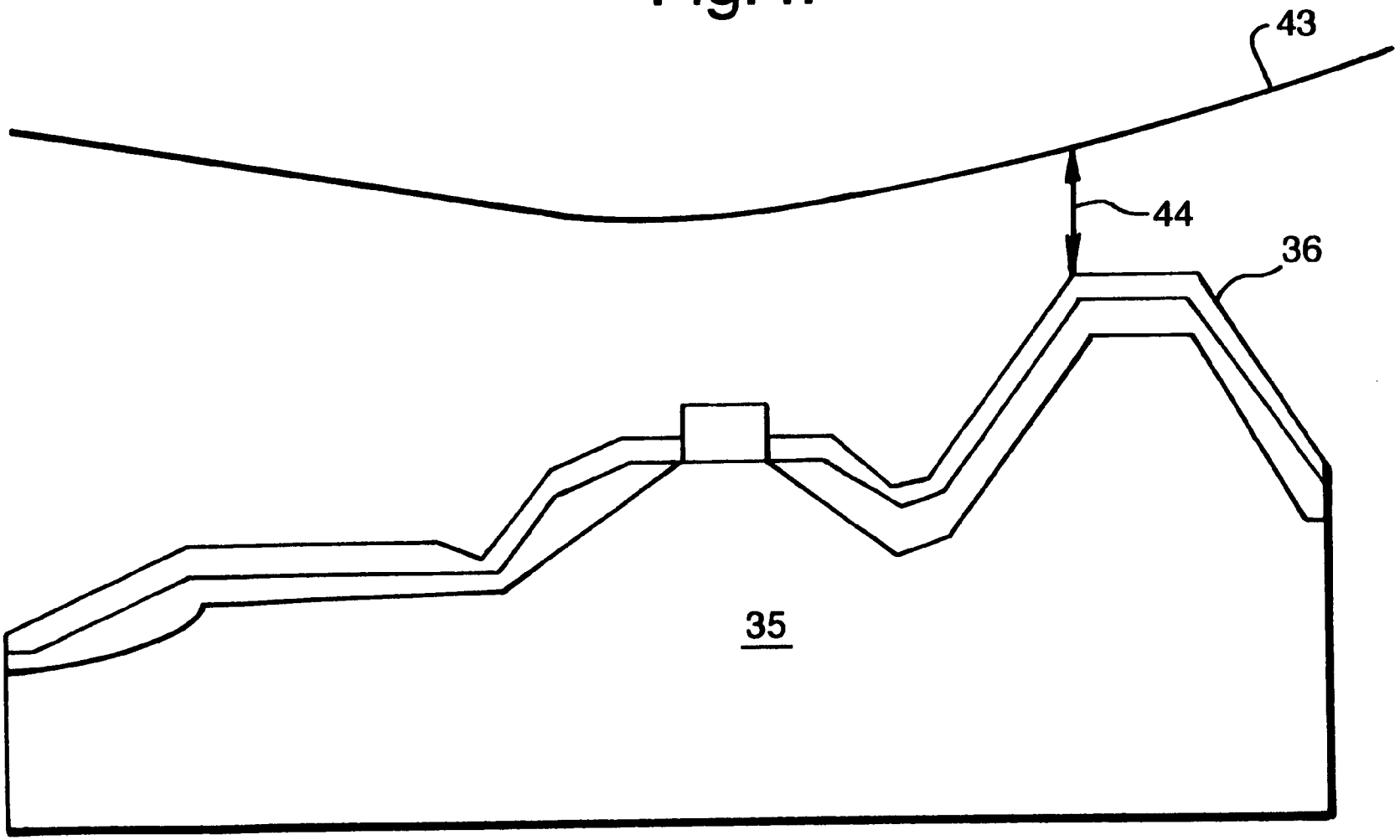
FIG. 4 is a schematic cross sectional view of worse case terrain profile and aircraft predicted flight path as generated using apparatus of FIGS. 1 and 2.

The worst case terrain profile generator 26 applies the scan area to the terrain retrieved from the terrain database store 4 by the search logic 22 to obtain all the terrain 33 and obstacles 34 within the scan area. The terrain and obstacles within the scan area 33 are used to produce a terrain profile as shown in FIG. 4. The scan terrain profile 35 is a two-dimensional terrain profile generated by the worst case terrain profile generator 26. One axis of the scan area terrain profile 35 represents the range from the aircraft and the second axis represents the maximum elevation of the terrain and obstacles within the scan area for the given range from the aircraft. A worst case terrain profile 36 is generated from the scan area terrain profile 35 by spreading the scan area terrain profile along the range axis by an amount which is a function of the uncertainty in the navigation position parallel to the current aircraft ground track and raising the maximum terrain and obstacle elevation by an amount which is a function of the uncertainty in the aircraft altitude.

The worst case terrain profile generator 26 may produce terrain profiles or additional scan areas 37 on either side of the main scan area 33 in FIG. 3 to allow the presence of hazardous terrain to the left or right of the aircraft to be determined. The apparatus also includes aircraft capability logic 38 as shown in FIG. 2 for receiving signals relating to the current aircraft configuration such as position of flaps, landing gear position, engine status and the proximity of other air traffic and calculates parameters for use by a flight path generator 39 and the comparator 13. The configuration information may also include aircraft mass and engine status and the information produced by the logic 38 includes the maximum aircraft vertical acceleration as shown by line 40, the maximum aircraft climb rate as shown by line 41 and minimum time to impact.

Figure 5:
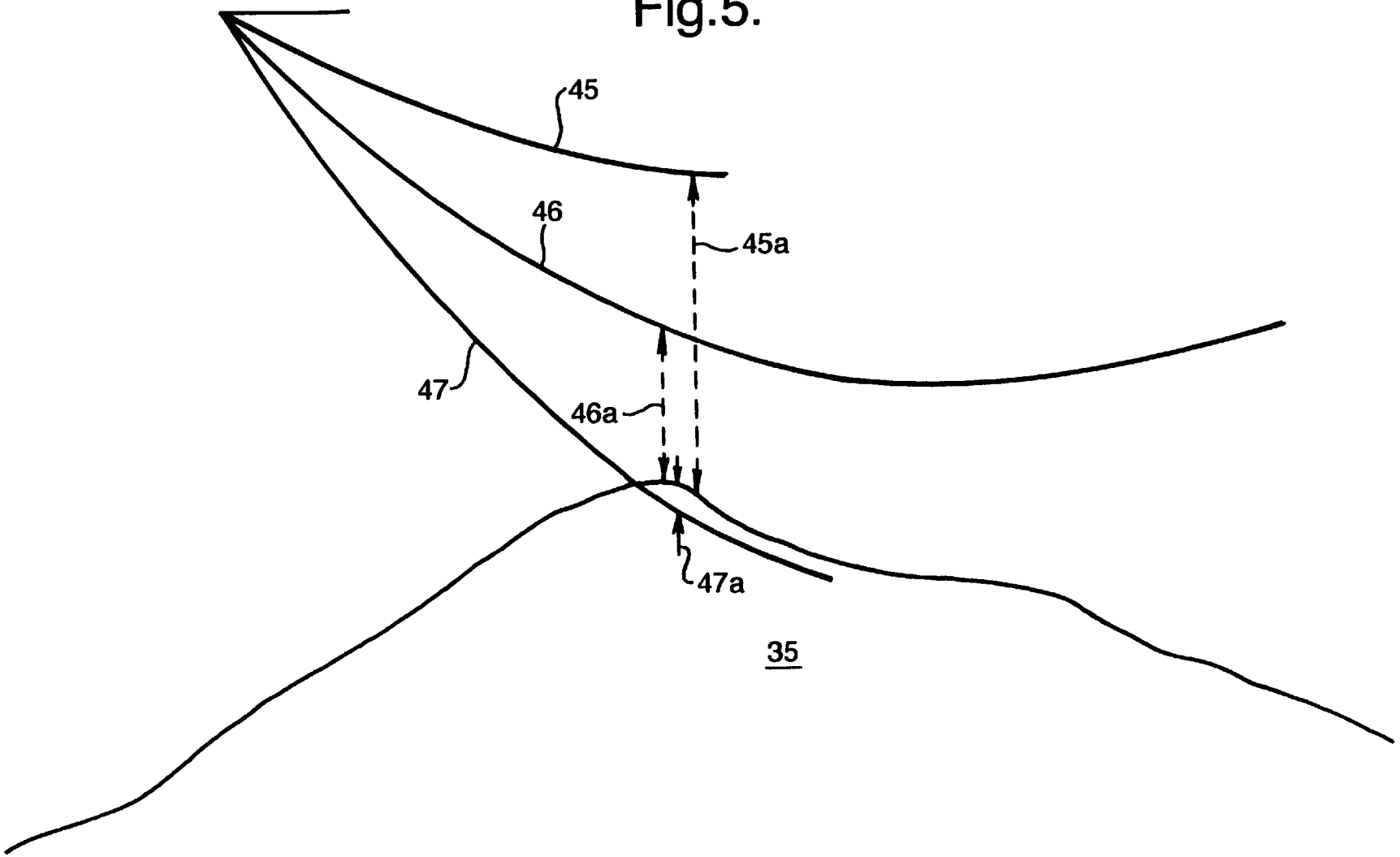
FIG. 5 is a schematic diagram illustrating recovery action taken to avoid a terrain collision threat.

The vertical flight path generator 39 receives signals relating to the current aircraft attitude for example by line 42 and vertical acceleration and calculates the predicted aircraft vertical flight path 43. The predicted aircraft vertical flight path may vary from a simple projection of the current aircraft velocity vector to a propagation of the current aircraft vertical velocity and acceleration to the inclusion of the response of the pilot and aircraft to the receipt of a warning or advisory signal. The generator 39 may produce more than one predicted vertical flight path 43 to enable different levels of warnings and cautions to be generated. For example the vertical flight path generator 39 may use different aircraft responses in the calculation of the predicted vertical flight path. The flight path generator may use different vertical flight paths 45,46,47 to determine maximum descent rates depending on the distances 45*a*, 46*a* and 47*a* from the ground 35 as shown in FIG. 5. Path 47 represents a collision flight path with a greater than maximum descent rate, whereas paths 45 and 46 shown permissible descent rates. The aircraft altitude may be based on the expected pilot reaction to the receipt of a ground collision avoidance warning.

The comparator 13 compares the worst case terrain profile 36 with the predicted aircraft vertical flight path 43 and produces a warning or advisory signal if the distance 44 between the two falls below a minimum terrain clearance distance. Additionally, a warning or advisory will be given if intersection with the terrain is predicted to be less than the minimum time to impact. Thus, the comparator 13 issues a ground collision avoidance warning via line 55 and/or a maximum descent rate or terrain left/right advisory via line 56.

The terrain elevations of the worst case terrain profile 36 are increased as a function of the uncertainty in the navigation solution altitude and are further increased by the minimum clearance distance 44. The minimum terrain clearance distance 44 is the minimum altitude above the terrain below which the aircraft may be assumed to be in a hazardous situation. The minimum safe altitude for an aircraft will change during take-off, landing, go-around and on-route so that the minimum terrain clearance distance may be a function of aircraft speed, configuration or proximity to an airfield.

The comparator 13 receives the worse case terrain profile 36 and the aircraft trajectory profile 53 and compares the altitude of the aircraft on the recovery trajectory with the worst case terrain height at all distances ahead of the aircraft within the scan area. If at any point the aircraft altitude is less than the worse case terrain height 44, then a warning or advisory signal is issued. The terrain warning generator 14 receives warnings and advisory signals from the traffic warning and/or avoidance signal generator 2 and from the terrain warning and/or avoidance signal generator 5 and produces visual and audio outputs. The audio outputs may take the form of speech describing either the nature of the warning or advisory or the corrective action to be taken. The visual output may take the form of warning lamps or lights.

What is claimed is:

1. An apparatus for indicating air traffic and terrain collision threats to an aircraft, comprising:

traffic advisory means for monitoring the position and behavior of air traffic in the vicinity of an aircraft provided with the apparatus and for generating a traffic signal regarding air traffic predicted to be on a collision course with the aircraft provided with the apparatus;

terrain advisory means for monitoring the position and behavior of the aircraft provided with the apparatus relative to terrain in the vicinity of the aircraft flight path and for generating a terrain signal for terrain features predicted to provide a collision threat to the aircraft flight path, wherein terrain information sent from the terrain advisory means to the traffic advisory means is used in the generating of the traffic signal and air traffic information sent from the traffic advisory means to the terrain advisory means is used in the generating of the terrain signal; and interactive means for receiving the traffic signal from the traffic advisory means and the terrain signal from the terrain advisory means, for comparing the traffic signal and terrain signal and for calculating a new signal from the traffic signal and the terrain signal which indicates an action for the aircraft to avoid both air traffic and terrain collisions.

2. The apparatus of claim 1, wherein the traffic signal is a warning signal.

3. The apparatus of claim 1, wherein the traffic signal is an avoidance signal.

4. The apparatus of claim 1, wherein the terrain signal is a warning signal.

5. The apparatus of claim 1, wherein the terrain signal is an avoidance signal.

6. The apparatus of claim 1, wherein the new signal is a warning signal.

7. The apparatus of claim 1, wherein the new signal is an avoidance signal.

8. The apparatus according to claim 1, wherein the traffic advisory means comprises:

a transponder for receiving position signals relating to the position of air traffic in the vicinity of the aircraft provided with the apparatus; and a traffic signal generator operable to receive output signals from the transponder, to calculate and monitor the position and behavior of air traffic in the vicinity of the aircraft and to generate the traffic signal.

9. The apparatus according to claim 8, wherein the traffic signal generator is connectable to a flight management system of the aircraft provided with the apparatus to receive aircraft operating information therefrom.

10. The apparatus according to claim 1, wherein the terrain advisory means comprises:

a store of representations of terrain and obstacles in and around the flight path of the aircraft provided with the apparatus;

a search logic device for retrieving data from the store within a predetermined latitudinal and longitudinal envelope defined relative to the aircraft position and velocity; and a terrain signal generator operable to receive, from a navigation system of the aircraft, signals representative of the latitude, longitude and altitude of the aircraft, calculate the predicted aircraft ground flight path, and generate the terrain signal.

11. The apparatus according to claim 8, wherein the terrain advisory means comprises:

a store of representations of terrain and obstacles in and around the flight path of the aircraft provided with the apparatus;

a search logic device for retrieving data from the store within a predetermined latitudinal and longitudinal envelope defined relative to the aircraft position and velocity; and a terrain signal generator operable to receive, from a navigation system of the aircraft, signals representative of the latitude, longitude and altitude of the aircraft, calculate the predicted aircraft ground flight path, and generate the terrain signal.

12. The apparatus according to claim 10, wherein the terrain generator includes a comparator for comparing the predicted aircraft ground flight path with a predetermined worst case terrain profile so that the terrain signal is issued upon occurrence of a predetermined condition.

13. The apparatus according to claim 11, wherein the terrain generator includes a comparator for comparing the predicted aircraft ground flight path with a predetermined worst case terrain profile so that the terrain signal is issued upon occurrence of a predetermined condition.

14. The apparatus according to claim 12, wherein the predetermined condition is the predicted aircraft altitude falling below a predetermined minimum clearance height at any point along the predicted ground flight path.

15. The apparatus according to claim 12, wherein the predetermined condition is when intersection with the terrain is predicted to be less than a predetermined time to impact.

16. The apparatus according to claim 13, wherein the predetermined condition is the predicted aircraft altitude falling below a predetermined minimum clearance height at any point along the predicted ground flight path.

17. The apparatus according to claim 13, wherein the predetermined condition is when intersection with the terrain is predicted to be less than a predetermined time to impact.

18. The apparatus according to claim 10, wherein the interactive means interlinks and forms part of the traffic signal generator and the terrain signal generator and wherein the new signal includes an electrical signal.

19. The apparatus according to claim 12, wherein the interactive means interlinks and forms part of the traffic signal generator and the terrain signal generator and wherein the new signal includes an electrical signal.

20. The apparatus according to claim 10, further comprising:

an auditory warning device and a visual avoidance display device for receiving output signals from the traffic signal generator and the terrain signal generator, the auditory warning device further configured to feed and output signals to the visual avoidance display device.

21. The apparatus according to claim 12, further comprising:

an auditory warning device and a visual avoidance display device for receiving output signals from the traffic signal generator and the terrain signal generator, the auditory warning device further configured to feed and output signals to the visual avoidance display device.

22. A method of indicating air traffic and terrain collision threats to an aircraft, comprising:

monitoring the position and behavior of air traffic in the vicinity of a first aircraft;

generating a traffic signal regarding air traffic predicted to be on a collision course with the first aircraft;

monitoring the position and behavior of the first aircraft relative to terrain in the vicinity of the first aircraft flight path;

generating a terrain signal for terrain features predicted to provide a collision threat to the aircraft flight path;

using air traffic information in the generating of the terrain signal;

using terrain information in the generating of the traffic signal;

receiving the traffic signal and the terrain signal at a receiver;

comparing the traffic signal and terrain signal; and calculating a new signal from the traffic signal and the terrain signal which indicates an action for the first aircraft to avoid both air traffic and terrain collisions.

23. The method according to claim 22, wherein the traffic signal is a warning signal.

24. The method according to claim 22, wherein the traffic signal is an avoidance signal.

25. The method according to claim 22, wherein the terrain signal is a warning signal.

26. The method according to claim 22, wherein the terrain signal is an avoidance signal.

27. The method according to claim 22, wherein the new signal is a warning signal.

28. The method according to claim 22, wherein the new signal is an avoidance signal.

29. The method according to claim 22, wherein the step of monitoring the position and behavior of air traffic comprises:

receiving position signals, at a transponder, relating to the position of air traffic in the vicinity of the first aircraft; and receiving output signals from the transponder at a traffic signal generator;

calculating and monitoring, at the traffic signal generator, the position and behavior of air traffic in the vicinity of the first aircraft.

30. The method according to claim 29, further comprising receiving aircraft operating information from a flight management system of the first aircraft connectable to the traffic signal generator.

31. The method according to claim 22, wherein the step of monitoring the position and behavior of the first aircraft relative to terrain:

retrieving data, from a store of representations of terrain and obstacles in and around the flight path of the aircraft provided with the apparatus, within a predetermined latitudinal and longitudinal envelope defined relative to the first aircraft position and velocity; and receiving, from a navigation system of the first aircraft, signals representative of the latitude, longitude and altitude of the aircraft, and calculating the predicted aircraft ground flight path.

32. The method according to claim 31, further comprising:

comparing the predicted aircraft ground flight path with a predetermined worst case terrain profile so that the terrain signal is issued upon occurrence of a predetermined condition.

33. The method according to claim 32, wherein the predetermined condition is the predicted aircraft altitude falling below a predetermined minimum clearance height at any point along the predicted ground flight path.

34. The method according to claim 32, wherein the predetermined condition is when intersection with the terrain is predicted to be less than a predetermined time to impact.

35. An apparatus for indicating air traffic and terrain collision threats to an aircraft, comprising:

traffic advisory means for monitoring the position and behavior of air traffic in the vicinity of an aircraft provided with the apparatus and for generating a traffic signal regarding air traffic predicted to be on a collision course with the aircraft provided with the apparatus; and terrain advisory means for monitoring the position and behavior of the aircraft provided with the apparatus relative to terrain in a geographical area along a predefined complete aircraft flight path of the aircraft and for generating a terrain signal for terrain features predicted to provide a collision threat to the predefined complete aircraft flight path, the terrain advisory means including a store containing a representation of the terrain in the geographical area along the predefined complete aircraft flight path wherein terrain information sent from the terrain advisory means to the traffic advisory means is used in the generating of the traffic signal and air traffic information sent from the traffic advisory means to the terrain advisory means is used in the generating of the terrain signal.

36. The apparatus according to claim 35, wherein the terrain information includes a maximum descent rate signal and a terrain left/right signal and the air traffic information includes a proximity of the air traffic in the vicinity.

37. The apparatus according to claim 35, further comprising:

interactive means for receiving the traffic signal from the traffic advisory means and the terrain signal from the terrain advisory means, for comparing the traffic signal and terrain signal and for calculating a new signal from the traffic signal and the terrain signal which indicates an action for the aircraft to avoid both air traffic and terrain collisions.

38. The apparatus according to claim 35, wherein the predefined complete aircraft flight path includes predefined complete diversion flight paths of the aircraft.

39. The apparatus according to claim 35, wherein the representation of the terrain includes a representation of obstacles in the geographical area along the predefined complete aircraft flight path.

40. The apparatus according to claim 35, the terrain advisory means further including:

a search logic device for retrieving data from the store within a predetermined latitudinal and longitudinal envelope defined relative to the aircraft position and velocity; and a terrain signal generator operable to receive, from a navigation system of the aircraft, signals representative of the latitude, longitude and altitude of the aircraft, calculate the predicted aircraft ground flight path, and generate the terrain signal.

41. The apparatus according to claim 1, wherein the terrain information includes a maximum descent rate signal and a terrain left/right signal and the air traffic information includes a proximity of the air traffic in the vicinity.

42. The method according to claim 22, wherein the terrain information includes a maximum descent rate signal and a terrain left/right signal and the air traffic information includes a proximity of the air traffic in the vicinity.

* * * * *

UNITED STATES PATENT AND TRADEMARK OFFICE

CERTIFICATE OF CORRECTION

PATENT NO. : 6,538,581 B2
DATED : March 25, 2003
INVENTOR(S) : Mark Cowie

It is certified that error appears in the above-identified patent and that said Letters Patent is hereby corrected as shown below:

Column 2,
Lines 3 and 27, after "Conveniently" insert -- , --.

Column 4,
Line 7, after "utilize" delete ",".

Column 6,
Line 26, after "Li" delete ",".

Signed and Sealed this

Third Day of February, 2004

JON W. DUDAS
*Acting Director of the United States Patent and Trademark Office*